US006523344B1

(12) United States Patent
Plassmeyer

(10) Patent No.: US 6,523,344 B1
(45) Date of Patent: Feb. 25, 2003

(54) HYDRAULIC SWITCHING APPARATUS

(75) Inventor: Joerg Plassmeyer, Bad Laer (DE)

(73) Assignee: Wilhelm Karmann GmbH, Osnabrueck (DE)

( * ) Notice: Subject to any disclaimer, the term of this patent is extended or adjusted under 35 U.S.C. 154(b) by 0 days.

(21) Appl. No.: 09/734,398

(22) Filed: Dec. 11, 2000

(30) Foreign Application Priority Data

Dec. 10, 1999 (DE) ..... 199 59 560

(51) Int. Cl.[7] ..... F15B 11/00
(52) U.S. Cl. ..... 60/464; 91/521; 91/525
(58) Field of Search ..... 91/517, 525, 178, 91/512, 521, 530, 531, 191, 192; 60/464

(56) References Cited

U.S. PATENT DOCUMENTS 5,819,536 A * 10/1998 Mentink ..... 60/464

FOREIGN PATENT DOCUMENTS

DE 3826789 A1 * 2/1990

* cited by examiner

*Primary Examiner*—Edward K. Look
*Assistant Examiner*—Thomas E. Lazo
(74) *Attorney, Agent, or Firm*—Jordan and Hamburg LLP

(57) ABSTRACT

A hydraulic switching device for use in a circuit comprises at least two movable drive units producing movement in a functional direction or a counter-direction. The drive units can be pressurized with a pressure medium via at least two connection lines. Externally controllable selector switches are provided for controlling the pressurization so that exactly one controllable selector switch is provided for each drive unit and at least two drive units are interconnected via logical AND and/or OR valve elements so that at least with introduction of force to the first drive unit in the functional direction, a force release of the second drive unit is possible, and with an introduction of force to the first drive unit in the counter-direction, an introduction of force to the second drive unit in the functional direction, in the counter-direction or a force release is made possible.

8 Claims, 15 Drawing Sheets

HYDRAULIC SWITCHING APPARATUS

Figure 1:
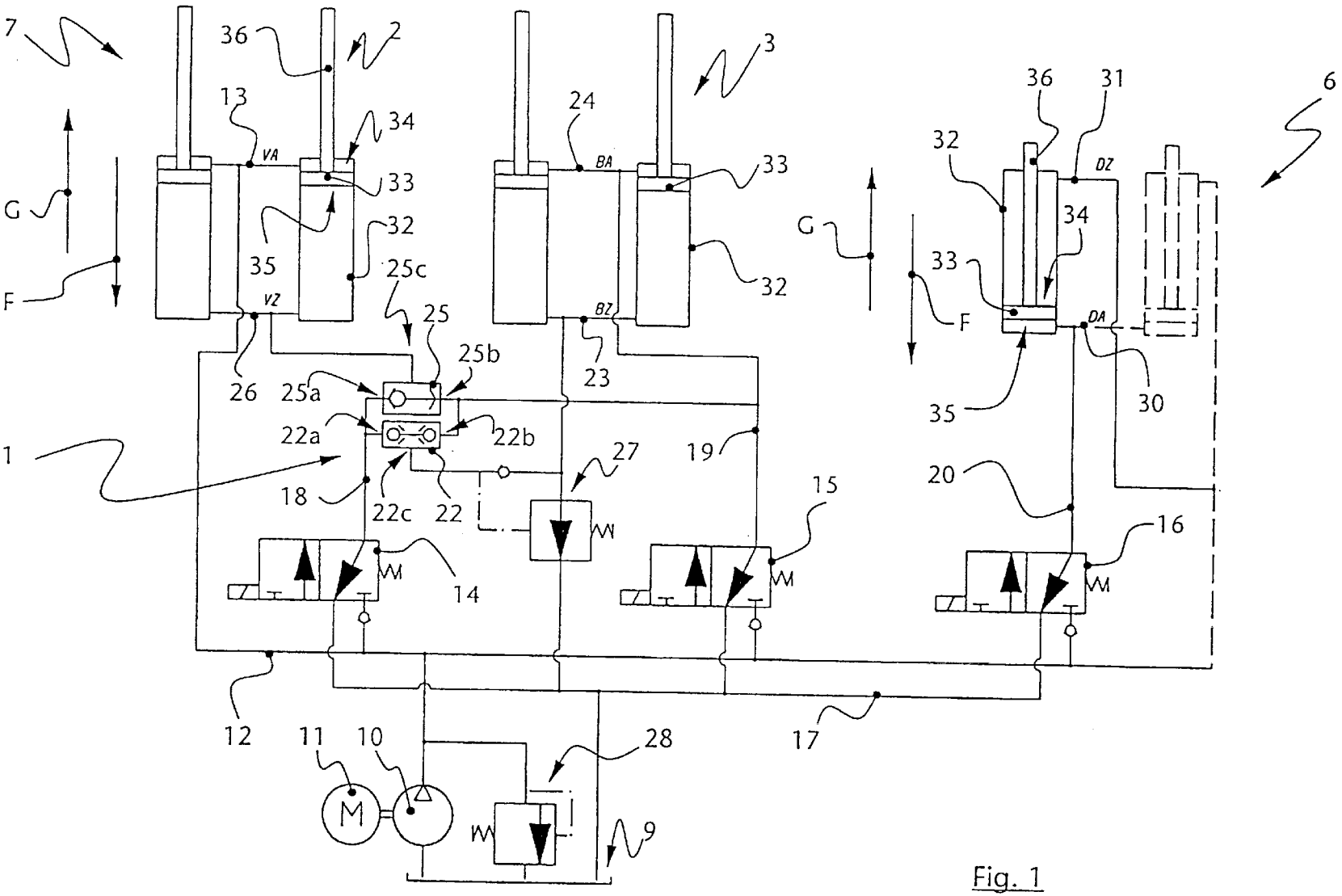

The invention relates to a hydraulic switching device.

European patent document EP 0 656 274 B1 discloses a circuit that can pressurize four outlets U1 to U4 with a pressure medium in different ways using a design of two controllable selector switches, namely, on the one hand, a reversing switch for controlling direction of pump rotation, and, on the other hand, an electro-motorized movable control valve. Due to the symmetry of the arrangement, switch conditions of the outlets are limited to a certain degree: if the first outlet is pressurized, only one selection capability remains for pressurizing the other outlets with a pressure medium. For example, if an outlet designated with U1 is pressurized (cf. FIG. 1), then the only available selection is, whether outlet line U3 shall be pressurized or if this line shall be switched pressure-less. In either case, outlets U2 and U4 will be pressure-less.

If there are more than four outlets, the problem remains that only one outlet strand can be pressurized at a time corresponding to the direction of rotation of the motor. This limits the application capabilities of such circuits. In addition, reversing the motor's direction of rotation takes a relatively long time and can be initiated only once a preceding movement phase has been concluded.

SUMMARY OF THE INVENTION

The object of the invention is to remove the above noted disadvantages without using additional electrically controllable selector switches.

A switching device of the present invention comprises a first drive unit, for example, a hydraulic cylinder or a pair of hydraulic cylinders, can be pressurized in one direction of movement, here in the counter direction. The second drive unit, for example, an additional hydraulic cylinder, has another three selection capabilities for pressurization: the direction of the function, the counter direction or a force-free switching. This results in a more favorable distribution of the switching capabilities with the same amount of electrically controllable selector switches such that new application capabilities are created.

A pump with one direction of rotation is used so that a second electrical control for selecting the pump's direction of rotation is dispensable. Furthermore, various pump types can be used while the pump selection is limited for reversible pumps. The breaks in movement when reversing the direction of the motor are thus eliminated. In addition, movement phases can overlap; for example, with a convertible vehicle, the soft top compartment cover can be moved during the opening of the bracket. The overall movement is faster.

By doing without the selector switch for reversing the pump direction, an additional 3/2-type valve, for example, can be used in the switching device while maintaining the expenditure in the electrical circuitry.

A particular simplification is achieved when, for example, with simultaneous pressurization of the connecting lines on both the piston rod side and the piston head side, an introduction of force is achieved that causes the piston rod to extend, because the cross-section on the side of the piston rod is smaller than that on the side of the piston head. In this case, when switching from retracting the piston (here considered the functional direction) to extending the piston (here considered the counter-direction), a reversal of the connecting line at the piston rod side can be avoided; only the connection on the piston head side needs to be pressurized.

The switching device finds a particular advantageous use in a convertible vehicle, where with a closed top, a bracket at the end of the soft top can be pressurized both in the opening and in the closing direction in order to enable the opening of the soft top compartment cover in the opening phase while it can be placed on top of it after closing the soft top compartment cover in the closing phase. In addition, the bracket must be switched pressure-less during the opening phase of the soft top. Thus, the second drive unit requires a total of three switch conditions and the first drive unit one switch condition, whereas during the switching of the first drive unit in the direction of opening the soft top, the drive for the bracket is to be kept pressure-less.

Additional advantages and features will become apparent from a first exemplary embodiment, where two drive units are interconnected, and from a second exemplary embodiment, where three drive units are interconnected.

IN THE DRAWINGS

Figure 2:
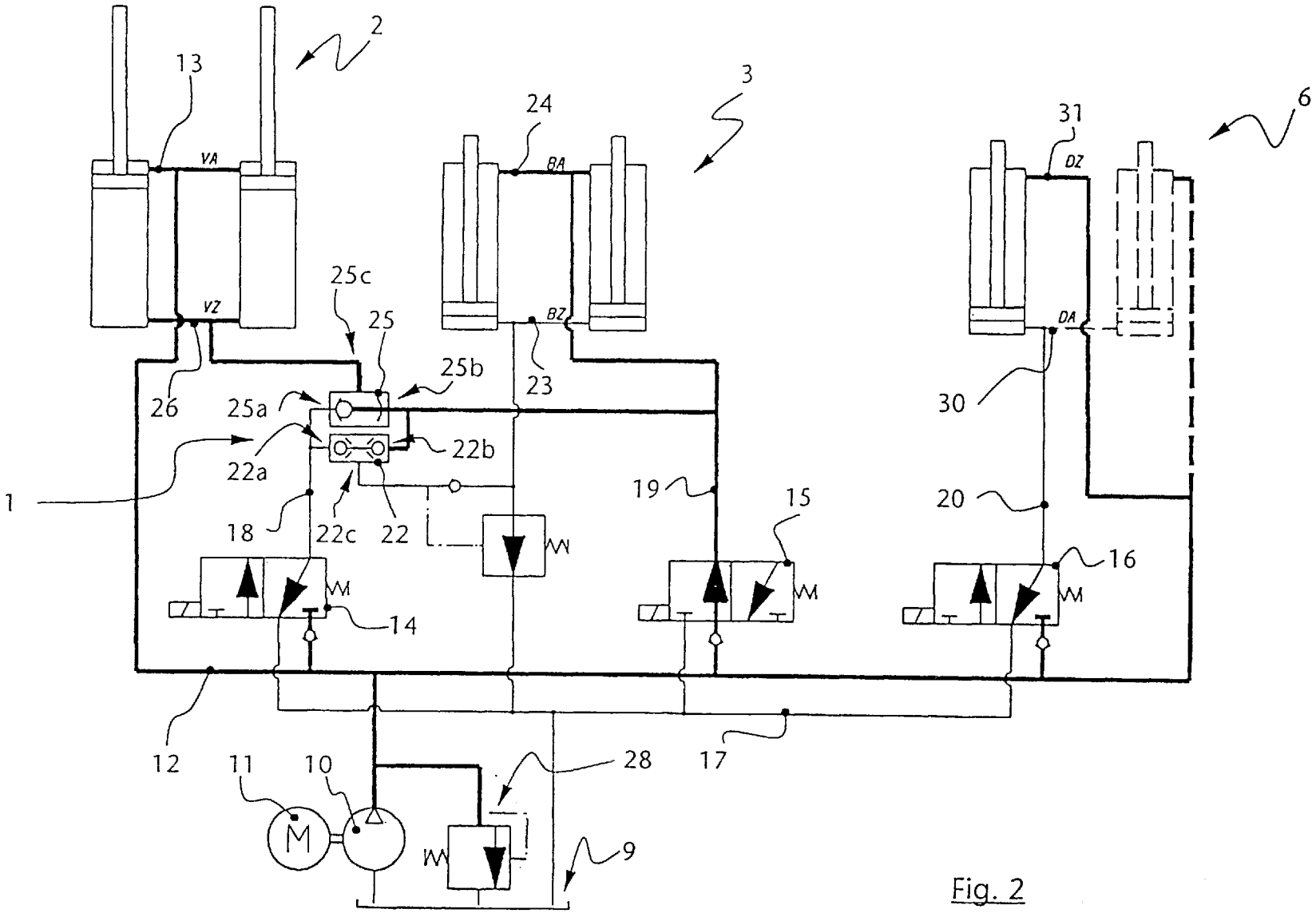
Figure 3:
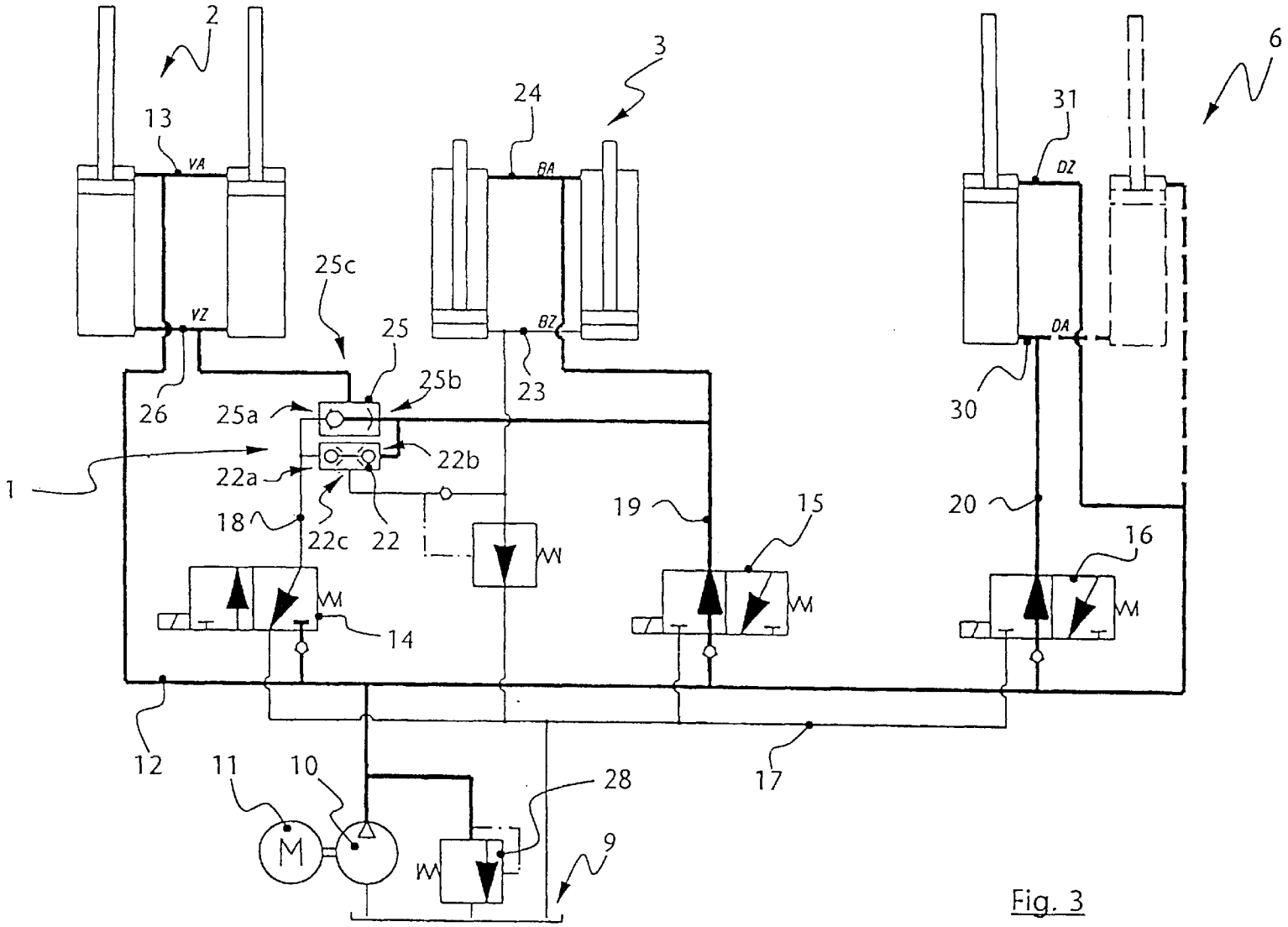
Figure 4:
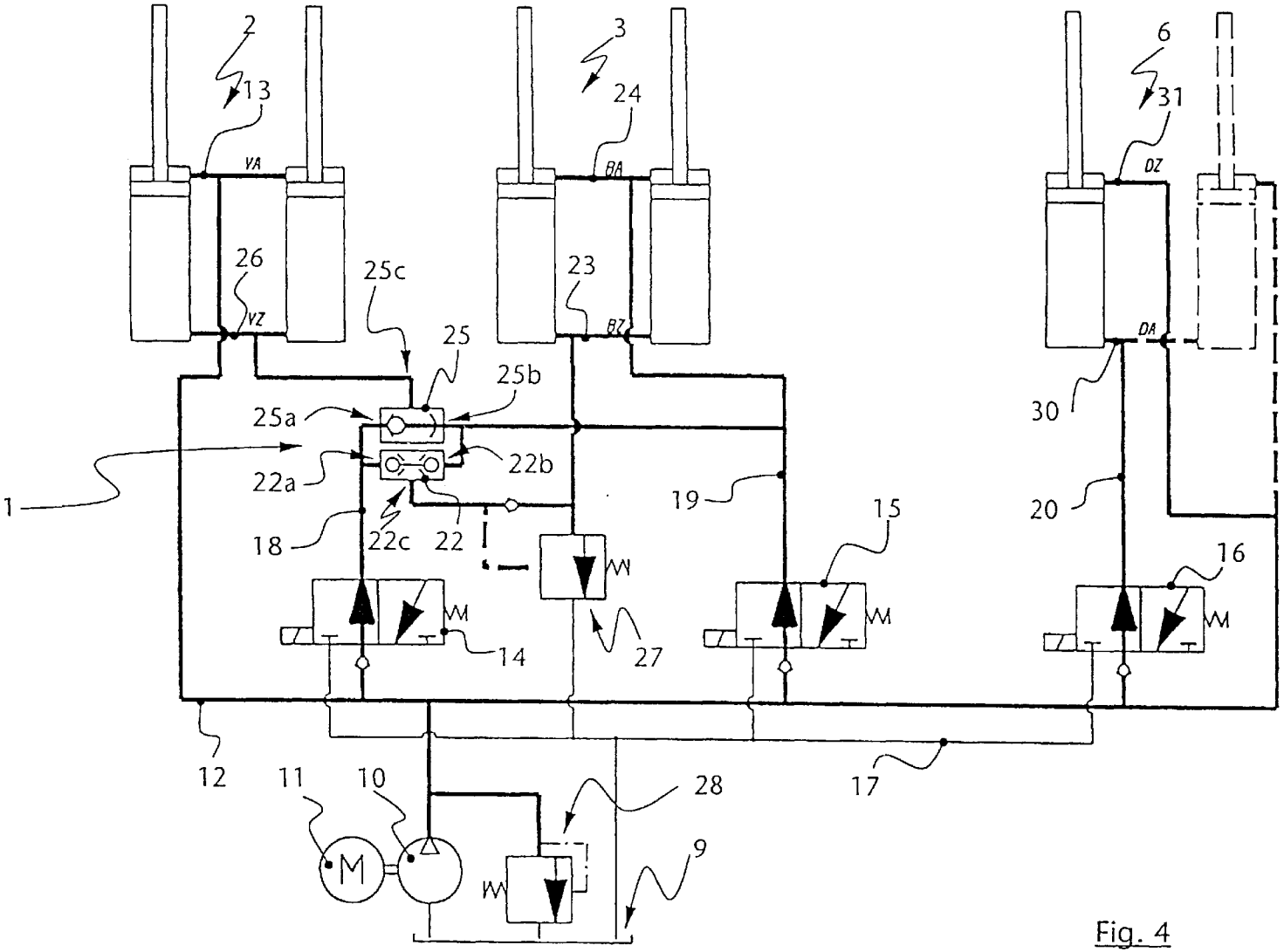
Figure 5:
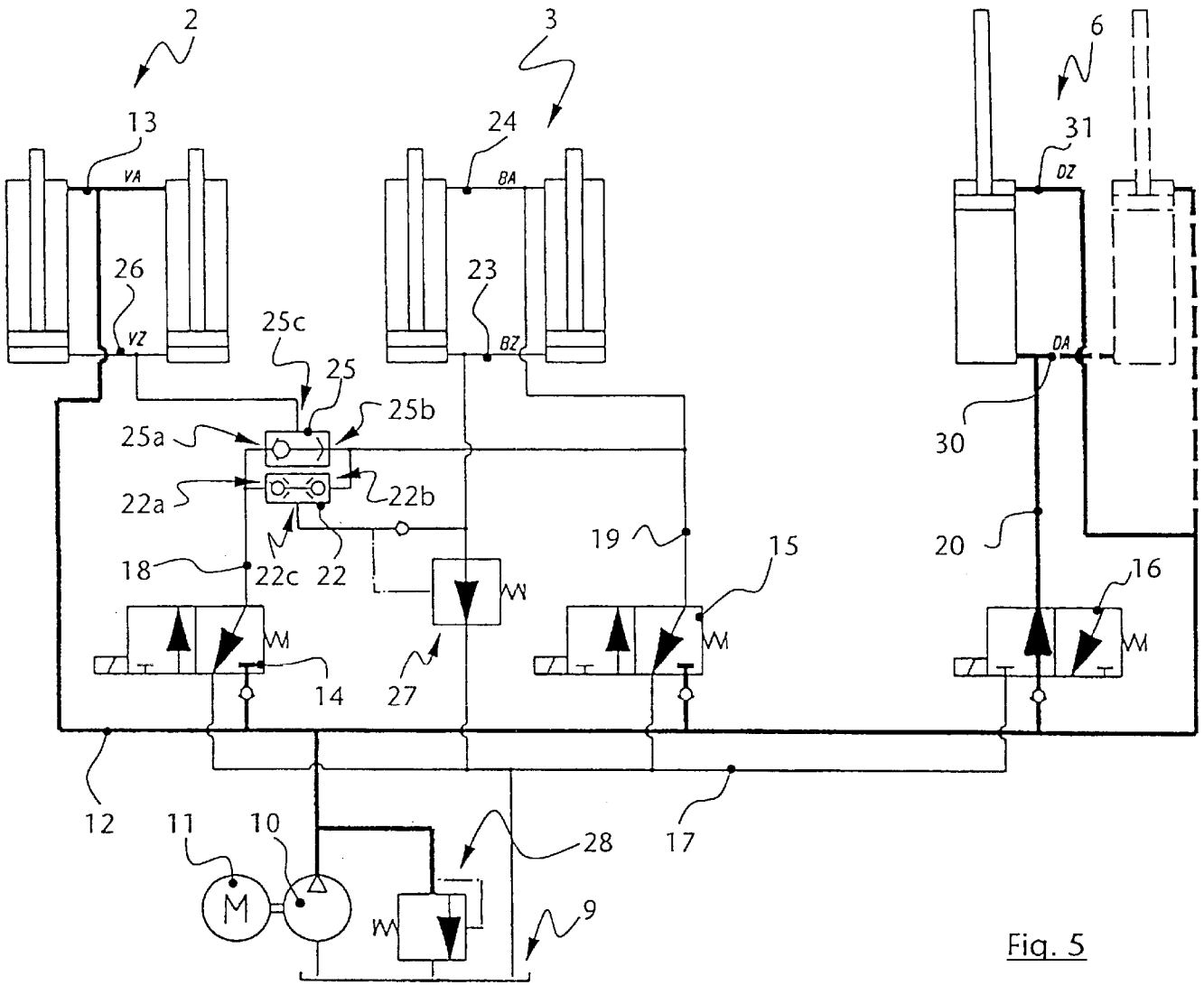
Figure 6:
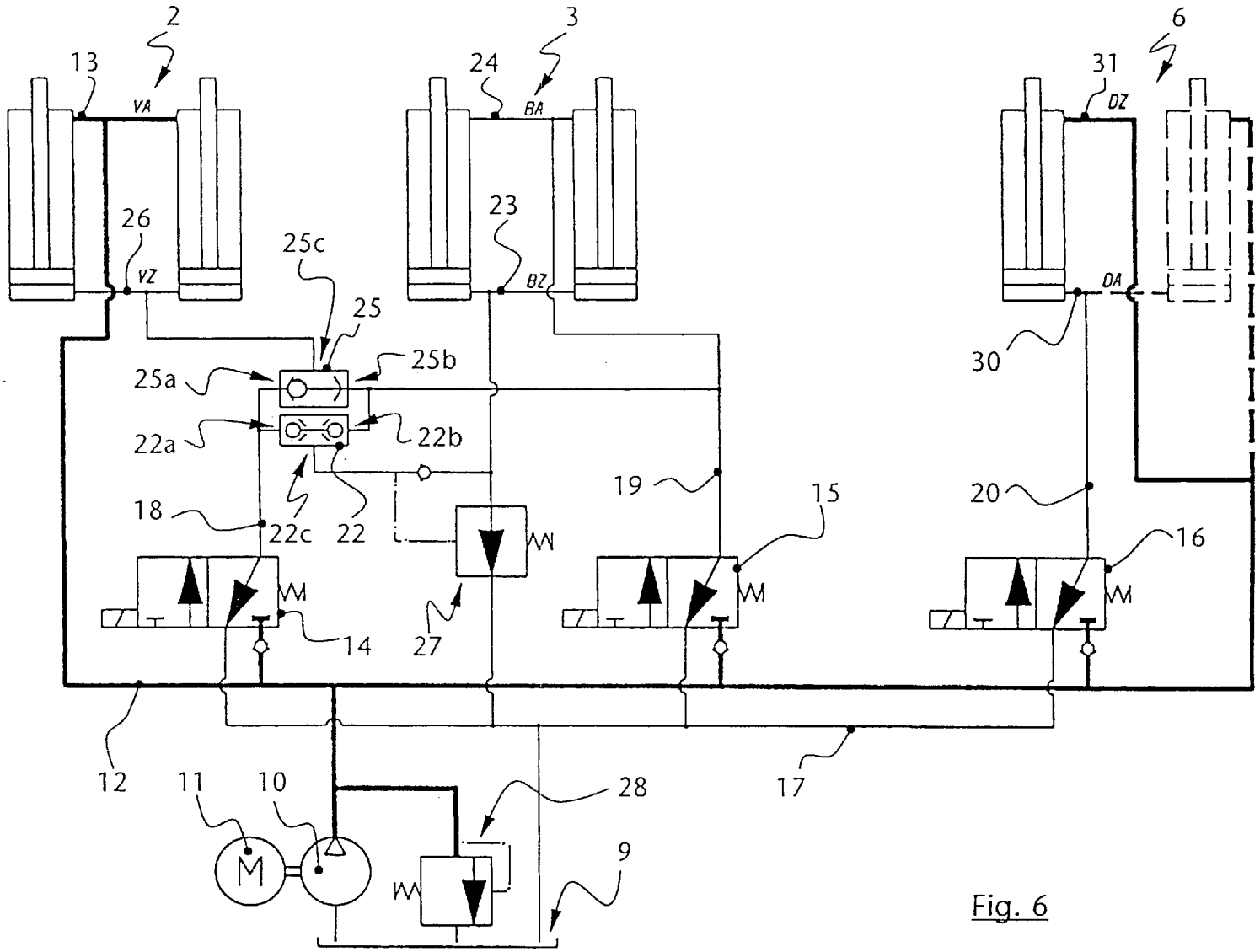
Figure 7:
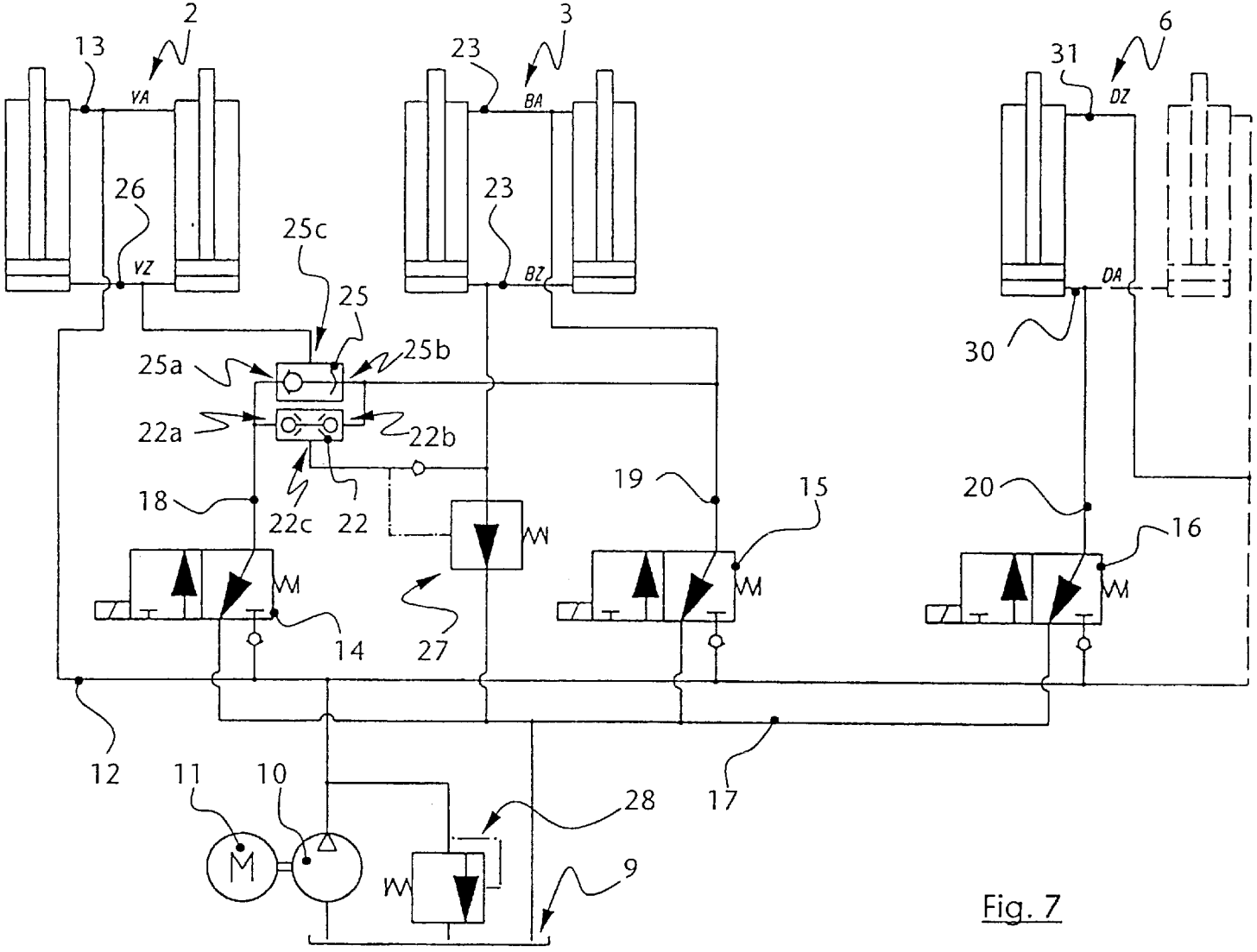
Figure 8:
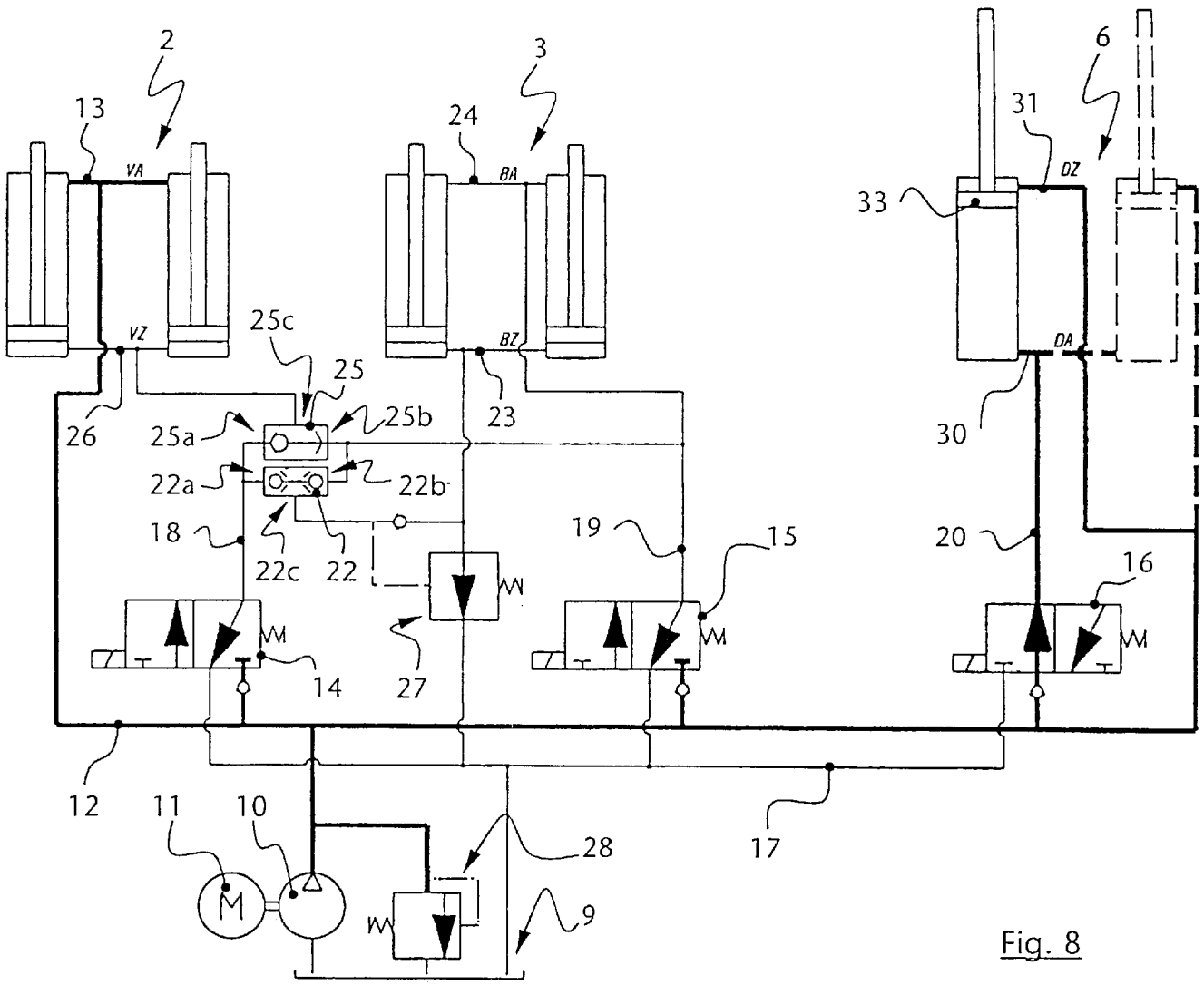
Figure 9:
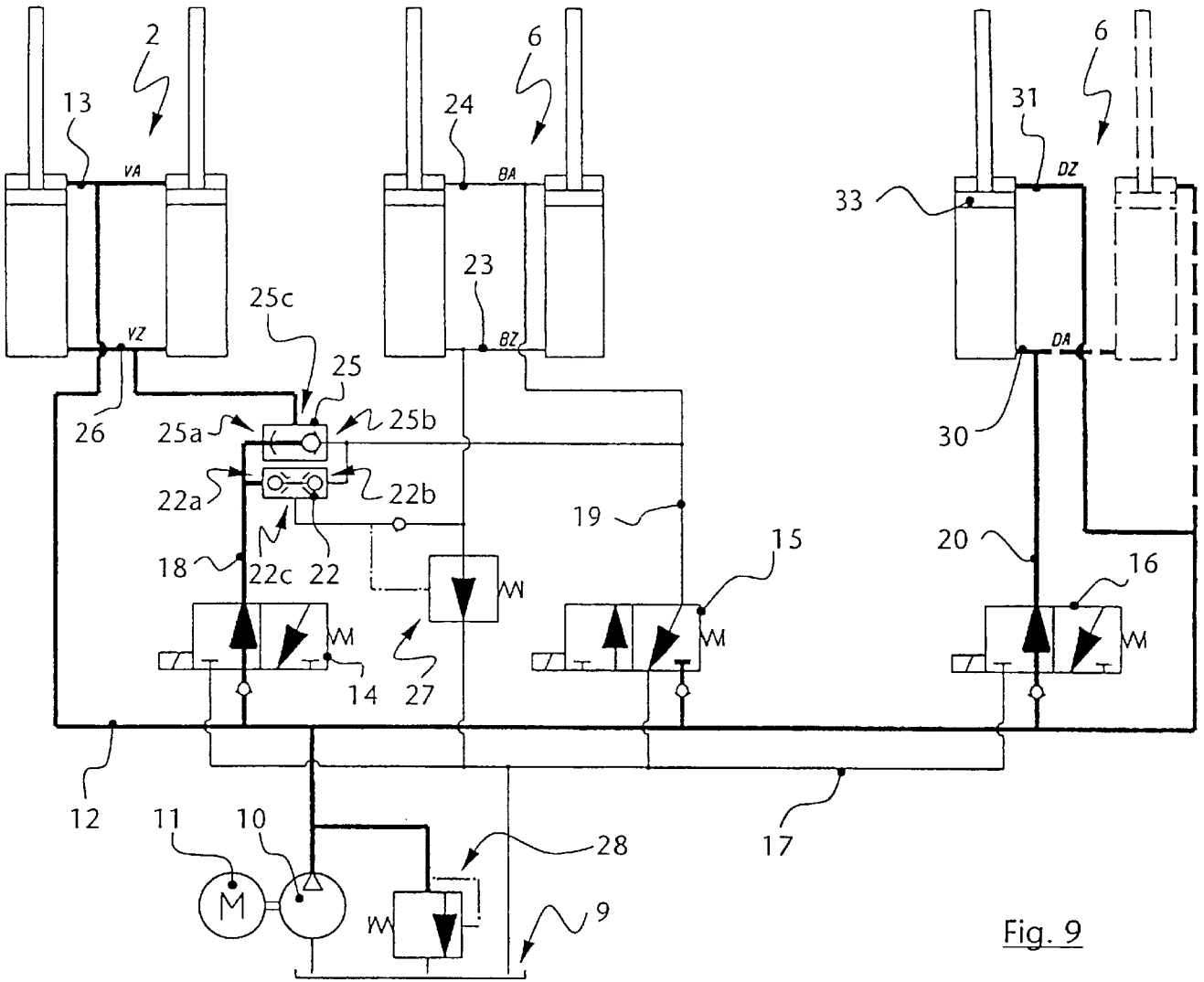
Figure 10:
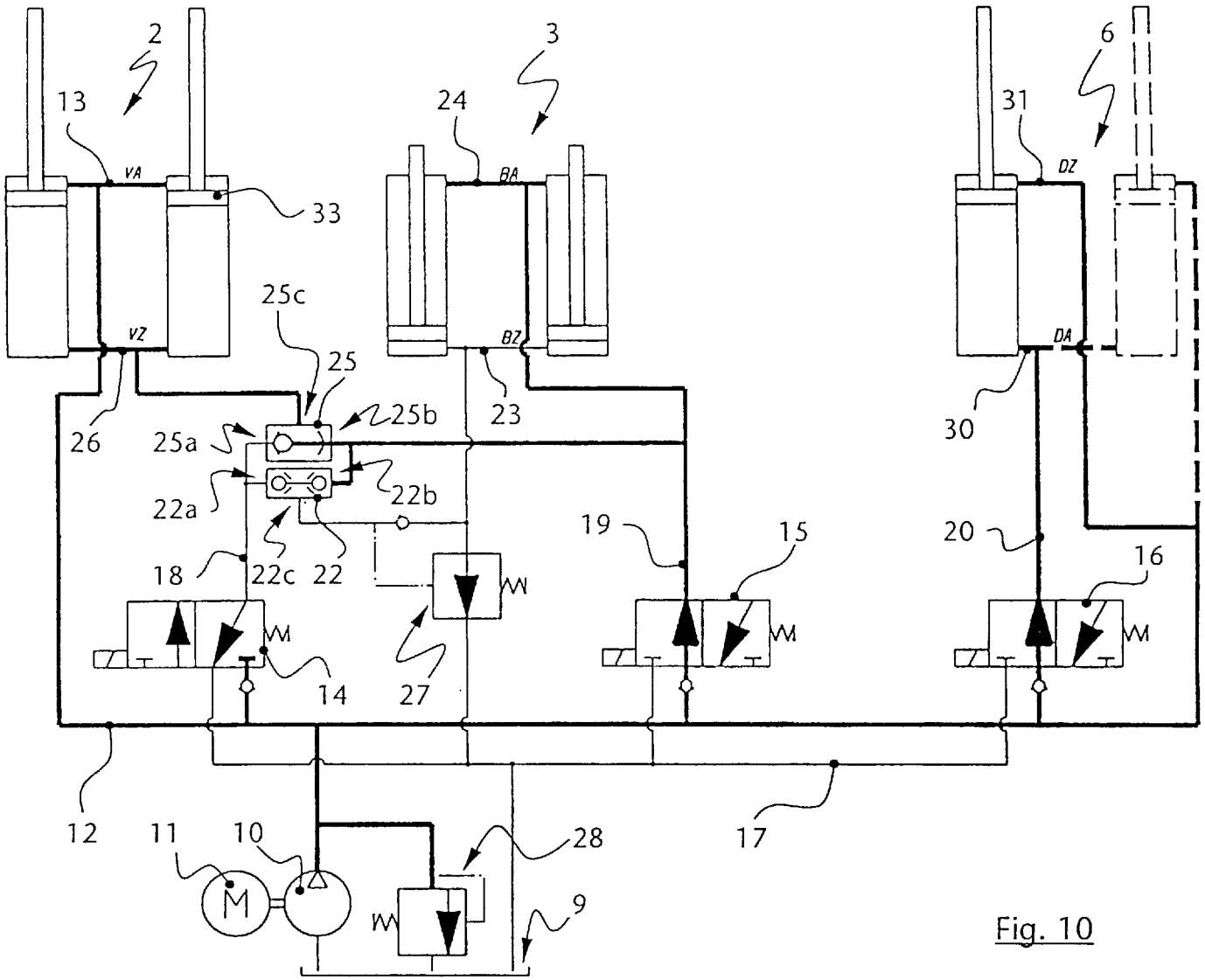
Figure 11:
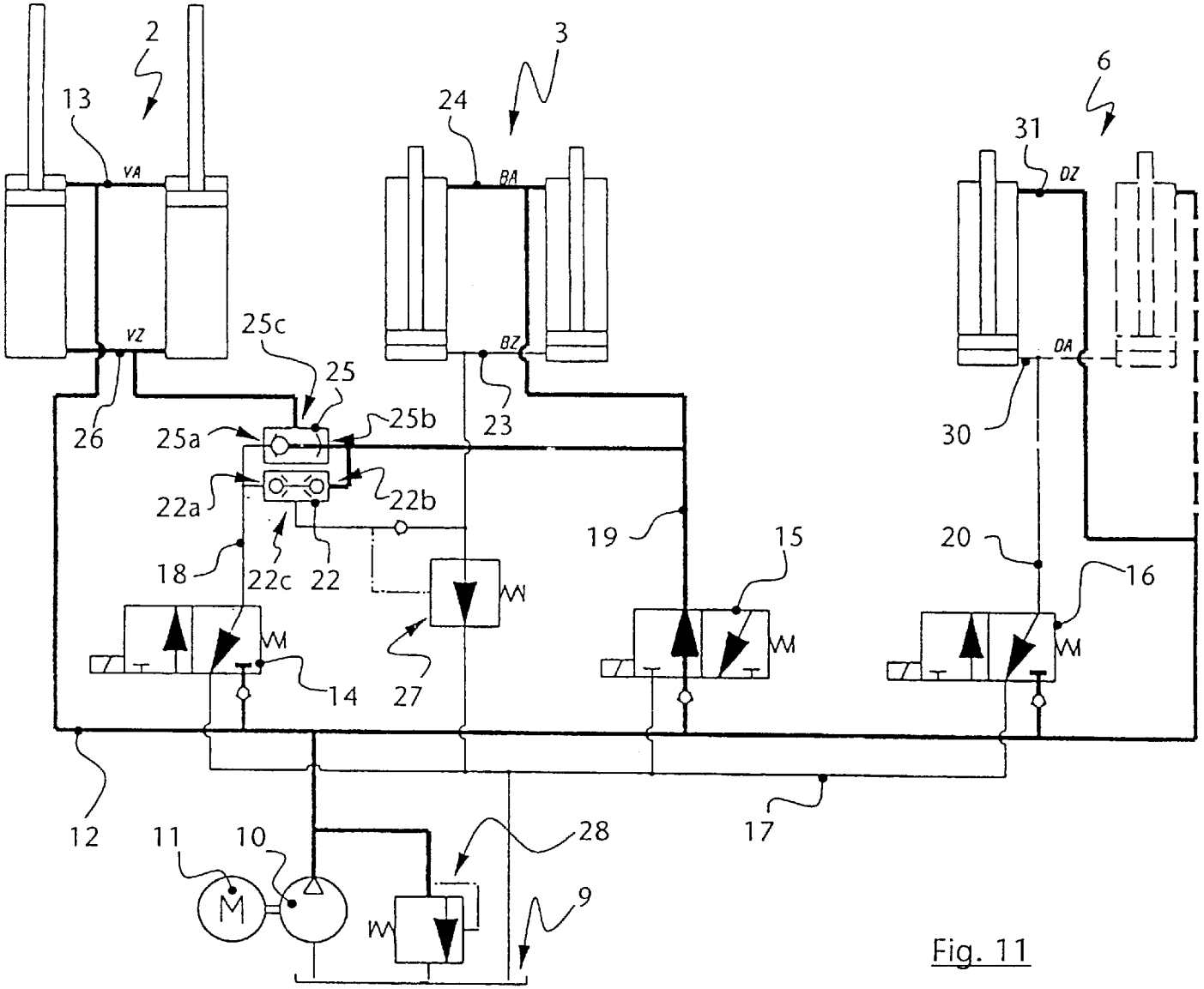
Figure 12:
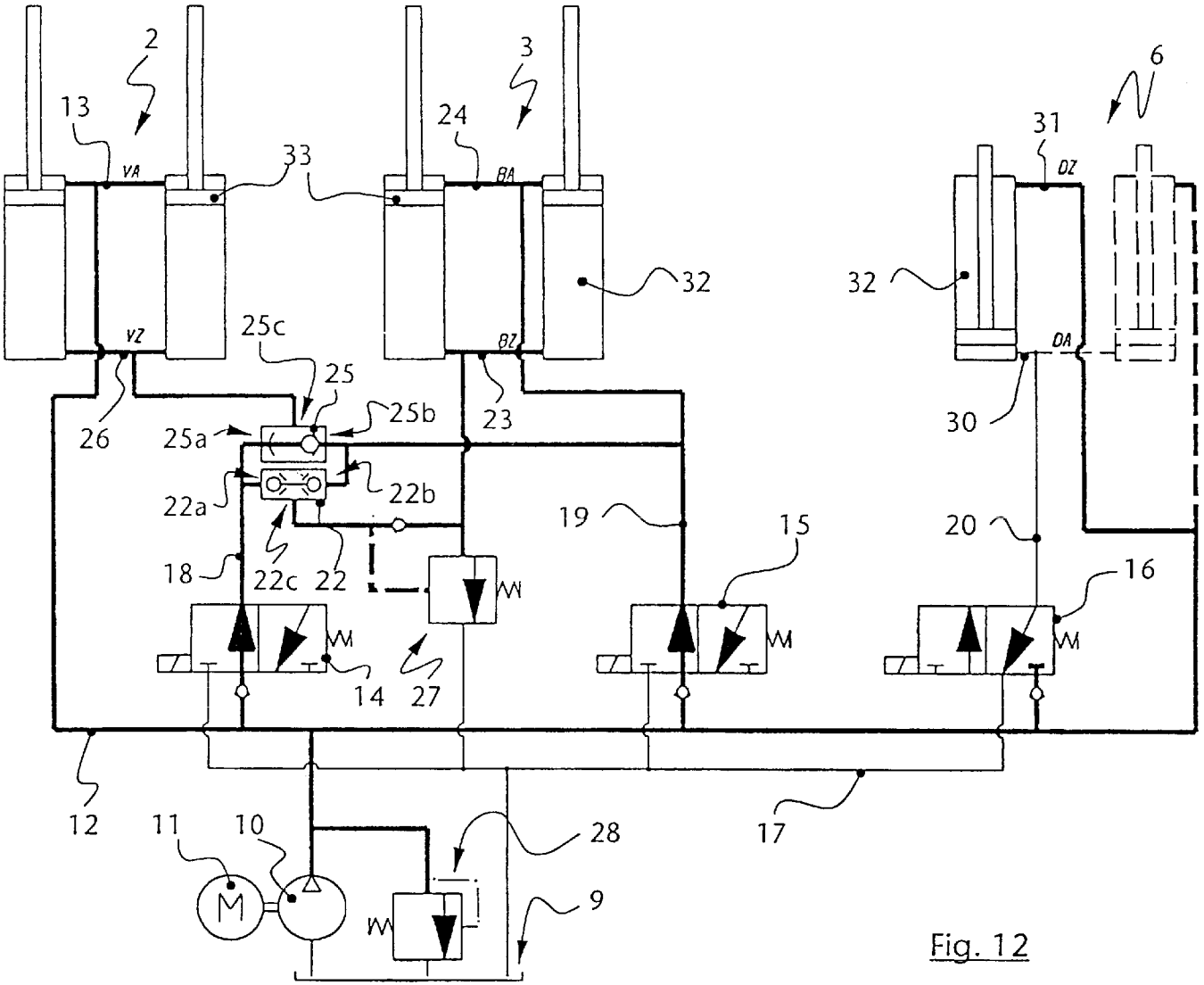
Figure 13:
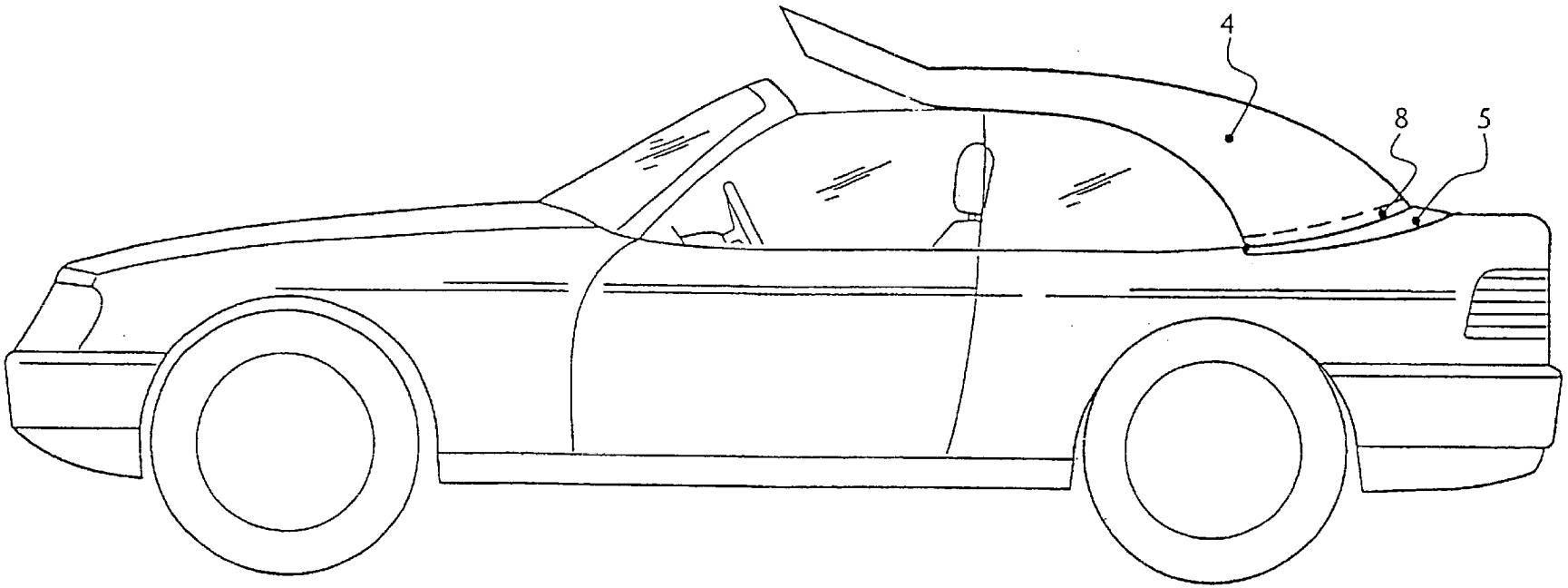
Figure 14:
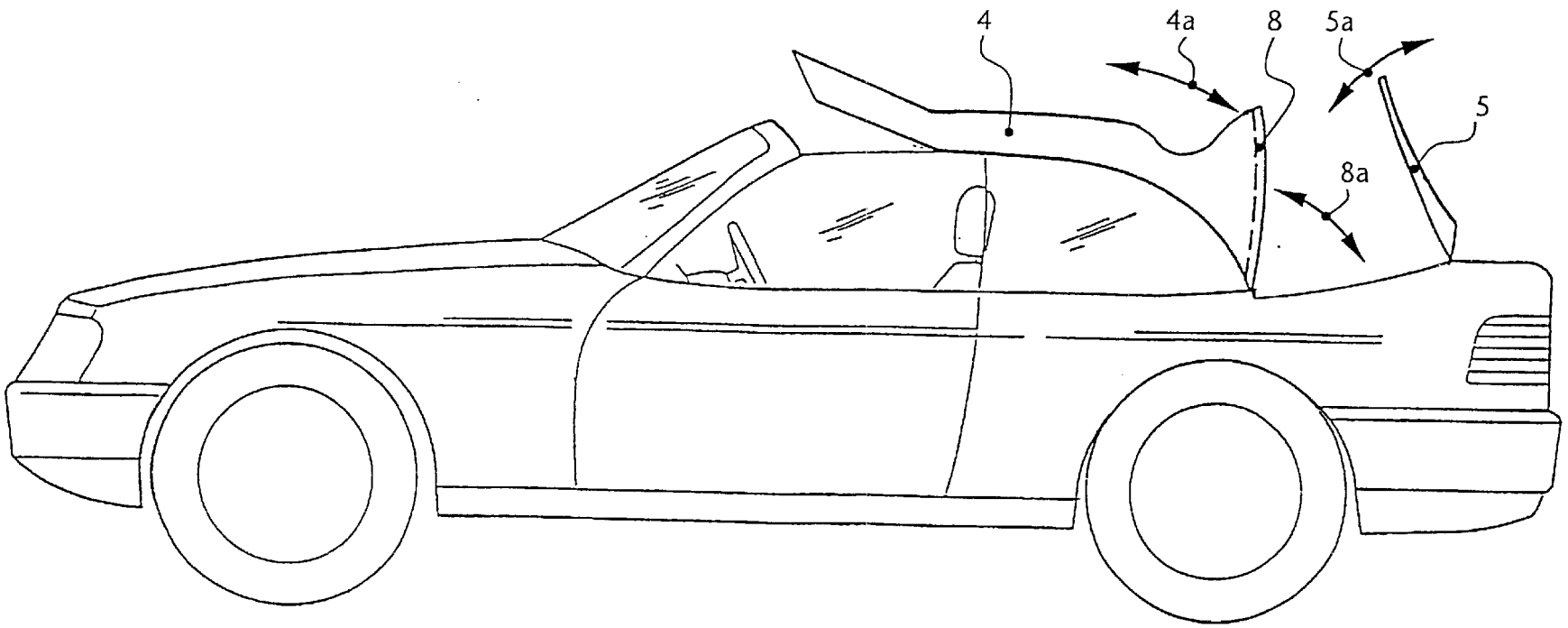
Figure 15:
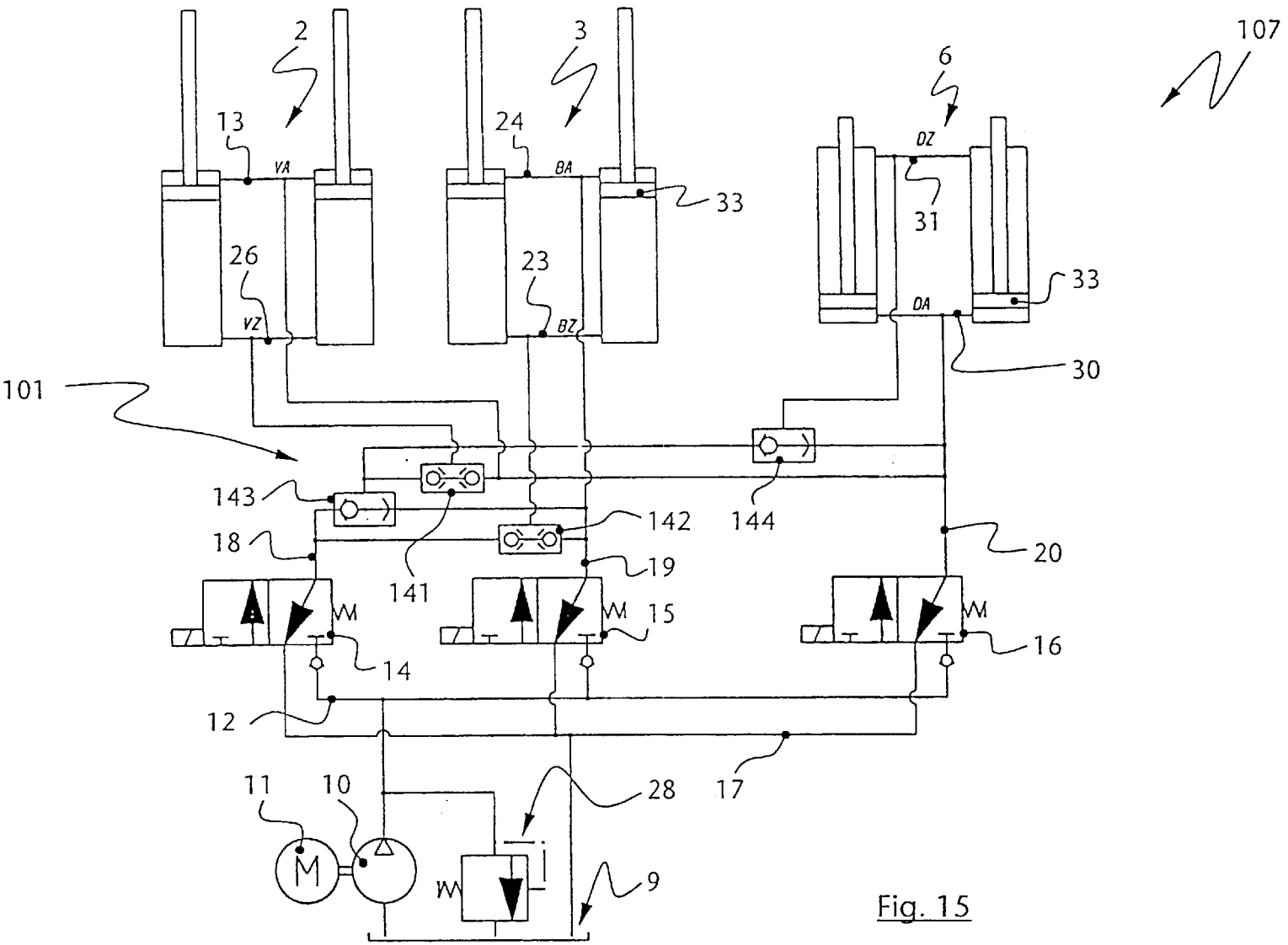

FIG. 1 shows a switching device subject to the invention in a circuit where a drive unit for a soft top movement and a drive unit for a bracket at the end of the soft top are interconnected and that additionally comprises, via a conventional selector switch, a drive unit for a soft top compartment cover that, in the closed condition of the soft top, is located underneath the bracket, FIG. 2 shows the circuit according to FIG. 1 in the open position of the bracket, FIG. 3 shows the circuit according to FIG. 2 in the open position of the bracket and of the soft top compartment cover, FIG. 4 shows the circuit according to FIG. 3 in the open position of the soft top compartment cover and the closed position of the bracket, FIG. 5 shows the circuit according to FIG. 4 in the open position of the soft top with the bracket drive being switched pressure-less, FIG. 6 shows the circuit according to FIG. 5 with an opened soft top and the closed position of the soft top compartment cover, FIG. 7 the circuit according to FIG. 6 in the idle position with an opened soft top and a closed soft top compartment cover, FIG. 8 shows the circuit according to FIG. 7 in the open position of the soft top compartment cover, FIG. 9 shows the circuit according to FIG. 8 in the closed position of the soft top, FIG. 10 shows the circuit according to FIG. 9 during the swing up movement of the bracket, FIG. 11 shows the circuit according to FIG. 10 in the closed position of the soft top compartment cover, FIG. 12 shows the circuit according to FIG. 11 with a closed roof, closed soft top compartment cover with a closed position of the bracket, FIG. 13 shows a convertible vehicle with a hinged soft top, a rear bracket and a soft top compartment cover in a schematic side view, FIG. 14 shows a similar view as FIG. 13 with schematically presented opening tracks of the soft top, bracket and soft top compartment cover, and FIG. 15 shows an alternative switching device subject to the invention with three interconnected drive units.

DESCRIPTION OF THE PREFERRED EMBODIMENT

According to a first exemplary embodiment (FIGS. 1 to 12), a switching device 1 of the present invention is employed in a circuit 7 for interconnecting first and second drive units 2,3. The first drive unit 2, for example, is provided for opening and closing of soft top 4, shown in FIG. 13, of a convertible vehicle. The second drive unit 2 is for opening and closing, namely for swinging up or down, a rear bracket that in the closed condition rests with the soft top on a soft top compartment cover 5. According to the first exemplary embodiment, a third drive unit 6 for controlling the open and closed condition of a soft top compartment cover 5 is provided in the circuit in a conventional manner and is not directly influenced by the switching device 1.

The circuit 7 comprises a reservoir 9 for a hydraulic medium as well as a pump unit 10 that can be driven via a motorized drive 11. The pump unit 10 comprises one or more pumps, that each operates in one feed direction. Various pumps come into consideration. The pressure medium that is fed by the pump unit 10 pressurizes a pressure medium line 12 that is directly connected to an open-control line 13 of the first drive unit 2. The pressure medium line 12 is connect to the reservoir 9 by an assigned pressure relief valve 28.

In addition, three externally controllable selector switches 14,15,16, one for each of the drive units 2,3,6, are provided that in the present case are designed as 3/2-type valves. On their outlet side, they are each connected to a control line 18,19,20 for one of the control units 2,3,6 and enable connection to the pressure medium line 12 or the return line 17. The control line 18 and a branch of the control line 19 form inlets 22*a* and 22*b* of an AND-valve element 22 which, on its outlet side 22*c*, is connected to a close-control line 23 for the second drive unit 3. An OR-valve element 25 connects the control line 18 and the aforementioned branch of the control line 19 at inlets 25*a*,25*b* a control line 26 of the first drive unit 2 at an outlet side 25*c* thereof. The OR-valve element 25 is connected in parallel to the AND-valve element 22. Via an additional branch, the control line 19 is directly connected to the open-control line 24 for the second drive unit 3. The close-control line 23 of the second drive unit 3 is connected to the return line 17 via a check valve 27.

The third drive unit has an open-control line 30 that is connected to the control line 20 that comes from the 3/2-type valve of the third selector switch, as well as a close-control line 31 that is directly connected with the pressure medium line 12.

The specified use of the switching device 1 as part of a circuit device 7 for a convertible vehicle is only an exemplary use for the switching device 1 of the present invention.

The drive units 2,3,6 are each provided as individual cylinders or pairs of hydraulic cylinders 32 having open-control lines 13,24,31 pressurized at a piston rod side and close-control lines 26,23 and 30 pressurized at the piston head side.

When pressurizing only the open-control lines 13,24,31 at the piston rod side, a movement in the functional direction of the drive units 2,3,6, namely the retraction of the piston 33, is effected. Conversely, when pressurizing only the close-control lines 26,23,30, at the piston head side, an opposite direction movement extending the piston 33 is effected. When pressurizing the piston rod side and the piston head side connecting lines 13 and 26, 24 and 23, or 31 and 30 at the same time, a resulting force introduction in the counter-direction is effected as well due to the smaller cross-sectional area 34 of the piston 33 at the piston rod side compared to the area 35 at the piston head side, that is, the pistons 33 will extend as well. The smaller cross-sectional area 34 is due to the cross-sectional area of the piston rod 36 that needs to be deducted.

In place of the hydraulic cylinders 32 other drive units such as rotating units that each can be moved in different rotation directions can be used. As indicated in a dashed line for the drive unit 6, the drive elements 32 do not need to be arranged in pairs, but one drive element may be sufficient as a drive unit.

FIG. 1 shows the circuit 7 in its pressure-less condition, i.e., all control lines 13,26,24,23 and 31,30 of the three drive units 2,3,6 are not pressurized with a pressure medium. The pistons 33 of the drive units 2,3 are extended, the pistons 33 of the drive unit 6 are retracted. For the exemplary convertible vehicle, whose movement sequences are described below for illustrative purposes, this condition would be established with a closed soft top 4, closed soft top compartment cover 5 and the bracket 8 resting on it. According to the additional Figures, the following steps for this example that may in part be carried out in an overlapping manner:

1. Swing up (opening) the bracket 8: Switching through of valve 15 (FIG. 2).
2. Opening of the soft top compartment cover 5: Switching through of valves 15 and 16 (FIG. 3).
3. Lowering of the bracket 8: Switching through of valves 14,15,16 (FIG. 4).
4. Opening of the soft top 4: Switching through of valve 16 (FIG. 5).
5. Closing of the soft top compartment cover 5 above the folded-in soft top 4: None of the valves 14,15,16 opens (FIG. 6).
6. Pressure-less switching when soft top 4 is open and folded in (FIG. 7).
7. Opening of the soft top compartment cover 5: Switching through of valve 16 (FIG. 8).
8. Closing of the soft top 4: Switching through of valves 14 and 16 (FIG. 9).
9. Swing up of the bracket 8: Switching through of valves 15 and 16 (FIG. 10).
10. Closing of the soft top compartment cover 5: Switching through of valve 15 (FIG. 11).
11. Swing down (closing) of the bracket 8: Switching through of valves 14 and 15 (FIG. 12).
12. Pressure-less switching of the entire system with a closed soft top 3 (FIG. 1).

In the Figures, the pressurized lines are shown in bold.

To swing up the bracket 8 according to FIG. 2 with a closed soft top 4 and a still closed soft top compartment cover 5, the pressure line 12 is pressurized with a pressure medium via the pump unit 10, and therefore also the open-control line 13 of the soft top drive unit 2 and the close-control line 31 of the soft top compartment cover drive 6 that are both directly connected to the pressure line 12. Valve 15 is switched such that the control line 19 is connected to the pressure line 12 and the open-control line 24 of the bracket drive 3 is pressurized with the pressure medium, such that the drive unit 6 experiences an introduction of force in one direction that will be designated as functional direction F without being emphasized in the claims and the description. Functional direction F and counter-direction G are exchangeable designations and only designate opposite directions of movements. At the same time, the inlet side 25*b* of the OR-element 25 is pressurized with the pressure medium via line 19, causing the outlet side 25*c* to be pressurized with the pressure medium as well.

Thus, the close-control line 26 of the soft top drive unit 2 is also pressurized. Thus, overall, a counter-directional force is exerted onto this drive unit 2 and the piston remains, therefore, in the extended position, where it has already been in the pressure-less condition according to FIG. 1.

In FIG. 3, an additional reverse switching of valve 16 is carried out causing the close-control line 20 of the soft top compartment cover drive 6 to be pressurized and the open-control line 30 as well. With the conditions of FIG. 2 otherwise unchanged, this causes an introduction of force onto drive unit 6 in the counter direction G. i.e., the piston 33 extends. Thus, the soft top compartment cover 5 opens due to pressurization with the bracket 8 in the open position.

In FIG. 4, the valve 14 is switched through with otherwise unchanged conditions, causing the inlet sides 22*a* of the AND-element 22 and 25*a* of the OR-element 25 to be pressurized with the pressure medium. Because the inlet sides 22*b* and 25*b* of the AND-element 22 and of the OR-element 25 on the opposite side are already pressurized due to the valve 15 being switched through, both will switch to passing through, so that no longer only the outlet side 25*c* of the OR-element 25—and therefore the close-control line 26 of the drive unit 2—is pressurized but also the outlet side 22*c* of the AND-element 22—and therefore also the close-control line 23 of the bracket drive unit 3 is pressurized. Thus, the bracket drive unit 3 moved in the counter direction and the bracket 8, therefore, moved downwards.

In the transition to FIG. 5, the valves 14 and 15 are each switched to return flow such that the control lines 18 and 19 at the outlet side are pressure-less. In this way, the inlet sides 22*a*,22*b* and 25*a*,25*b* of the AND-element 22 and the OR-element 25 are pressure-less. Accordingly the outlet lines 22*c* and 25*c* are pressure-less as are in turn the control lines 26 and 23 of the soft top drive unit 2 and the bracket drive unit 3. Therefore, the soft top drive unit 2, whose control line 13 is directly connected to the pressure line 12, is moved in the functional direction, that is, the piston 33 is retracted. The soft top 4 will be opened by this action. During this procedure, the bracket drive unit 3 is switched fully pressure-less. This is achieved through the return flow switching of valve 15, causing the control line 19, which directly pressurizes the open-control line 24, to remain pressure-less as well as the inlet 22*b* of the AND-element 22, such that also the outlet line 22*c* that pressurizes the close-control line 23 remains pressure-less. The soft top compartment cover 5 is not affected by this and remains open in this position.

According to FIG. 6, with unchanged circumstances with regard to the soft top drive 2 as well as the bracket drive 3, the control valve 16 is switched to return flow, causing the open-control line 30 of the soft top compartment cover drive 6 to be switched pressure-less. The close-control line 31 remains pressurized, such that overall the soft top compartment cover drive 6 is moved in the functional direction F, that is, the piston 33 is retracted. In this manner, the soft top compartment cover 8 closes above the folded in soft top 3.

After closing the soft top compartment cover 5, the pump unit 10 can be taken out of operation, such that the pressure line 12 is brought into a pressure-less state and the soft top compartment cover 5, is held in its position above the soft top 3, for example, by an engaged lock. Since this is a continuous position when the roof is open, it is prudent from an energy standpoint to fully switch off the pressurization according to FIG. 7. It is also possible to keep the circuit according to FIG. 6, that is, to continuously pressurize the soft top compartment cover 8 in the closing direction and to pressurize the soft top 4 via its drive unit 2 in the opening direction.

To close the soft top (FIG. 8 to FIG. 12), the aforementioned steps are carried out in reverse order, i.e., first the pressure medium line 12 is pressurized with the pressure medium via the pump unit 10 for all subsequent steps. In this manner, the open-control line 13 of the soft top drive 2 and the close-control line 31 of the soft top compartment cover drive 6 are pressurized with a pressure medium and remain pressurized for the entire closing of the soft top 4.

First (FIG. 8), valve 16 is switched through, so that the open-control line 30 of the soft top compartment cover drive 6 is pressurized with a pressure medium, and is, therefore, moved in the counter-direction, that is, the piston 33 extends. As a result, the soft top compartment cover 5 opens.

After opening the soft top compartment cover 5, the soft top 4 is closed via the switching through of valve 14 (FIG. 9). The bracket drive 3 remains pressure-less. By reversing the valve 14 in the switch-through direction, the control line 18 is pressurized with the pressure medium. Thus, pressure is present at an inlet 25*a* of the OR-element 25 and also at the outlet 25*c*. Accordingly, the close-control line 26 of the drive unit 2 is pressurized to produce force in the counter-direction. The piston 33 extends and the soft top 4 is closed. In this phase, the inlet 22*b* of the AND-element 22 is kept pressure-less, so that its outlet side 22*c* and therefore also the close-control line 23 of the bracket drive 3 remains pressure-less. This causes the bracket 8 to be moved in a pressure-less state together with the soft top 4.

In order to be able to close the soft top compartment cover 5 with a closed soft top 4, the bracket 8 must initially swing upwards. For this purpose, according to FIG. 10, the valve 15 is switched through and the valve 14 switched to return flow. In this manner, a pressure is present at both inlets 22*b* and 25*b* of the AND-element 22 and of the OR-element 25, respectively, while the inlets 22*a* and 25*a* on the opposite side are pressure-less. Only the outlet line 25*c* of the OR-element is pressurized, so that with regard to the drive unit 2 for the soft top 4, both the open-control line 13 and the close-control line 26 remain pressurized and overall, the drive unit 2 remains pressurized in the counter-direction G, that is, in the direction of the piston extension. The outlet line 22*c* of the AND-element 22 remains pressure-less and therefore also the close-control line 23 of the bracket drive unit 3. However, with the pressurization of the drive line 19, the open-control line 24 is pressurized, so that overall the bracket drive unit 3 for the bracket 8 is moved in the functional direction F, and thus, the bracket 8 swings upward (opens).

According to FIG. 11, the soft top compartment cover 5 is closed under the bracket 8. To this end, with otherwise unchanged conditions, the valve 16 is switched to return flow, such that the open-control line 30 of the drive unit 6 becomes pressure-less and the close-control line 31 remains pressurized, and therefore, the soft top compartment cover 5 closes.

To return to the initial situation, the bracket drive 3 is then closed according to FIG. 12. To this end, the open-control line 24 is pressurized by switching through the control valve 15. However, at the same time pressure is applied to the inlet sides 22*a* and 25*a* of the AND-element 22 and the OR-element 25 by switching through valve 14, such that the outlet line 22*c* and therefore also the close-control line 23 of the drive unit 3 are pressurized, so that the bracket drive 3 experiences an overall introduction of force in the counter direction, that is, the piston 33 is extended and the bracket 8 closes.

In FIGS. 13 and 14, the movement possibilities of the soft top compartment cover 5, of the soft top 4 and of the bracket 8 are each indicated by arrows 4*a*,5*a* and 8*a*.

Generally, the exemplary embodiment enables that the drive unit 2 for the soft top 4 is pressurized in the counter-direction G for closing the soft top 4 and thereby to keep the bracket drive 3 either in the opening direction F (FIG. 2) or pressure-less (FIG. 9) or moving it in the counter-direction G (FIG. 12). In this manner, three different resulting introductions of force on the second drive unit 3 can be realized while the introduction of force on the first drive unit 2 remains the same, without requiring an additional controllable selector switch 14,15 or 16. If, in place of the switching device 1, only drive units 2 and 3 were coupled with one another as is indicated in the first exemplary embodiment for drive unit 6, then—with one switch position for drive unit 1—there would be only two switch positions for drive unit 2 and, therefore, not the aforementioned third switch position.

According to a second exemplary embodiment, the drive units 2,3 and 6 are fully interconnected via two logical AND-elements 141,142 and two logical OR-elements 143, 144 each designed as valves that can be controlled by the pressure medium itself.

The sequence for opening or closing the soft top 4, the soft top compartment cover 5 and the bracket 8, that can be movable via drive units 2,3 and 6, for example, would run similar to that described above. From the pressure-less position presented in FIG. 15, which corresponds to that in FIG. 1, the bracket 8 would initially swing up by switching through the selector switch 15, here again designed as a 3/2-type valve. By reverse switching valve 15, the control line 19 is connected to the pressure line 12; in doing so, the open-control line 24 is pressurized, the pistons 33 of the drive unit 3 retract and the bracket 8 opens.

In this position of the bracket 8, the soft top compartment cover 5 is opened through additional switching through of the selector switch 16. The control line 20 is connected to the pressure line 12 and the open-control line 30, therefore, pressurized, so that the pistons 33 of the drive unit 6 extend. By pressurizing the control line 20, an inlet of the of the OR-element 144 is pressurized with the pressure medium, so that via its outlet the close-control line 31 is also pressurized, which will, however, lead to an extension of the piston 33 as a result of the aforementioned different cross-sections of the active surface of the pressure medium on the side of the piston head and the side of the piston rod.

In the next step, the bracket 8 is lowered, which is accomplished by switching through the selector switch 14. This pressurizes the control line 18 as well as the left inlet of the OR-element 143 and the AND-element 142. Since the right inlet of the OR-element 143 is also pressurized via the control line 19, the close-control line 23 for the bracket 8 that is connected to the outlet line is pressurized, so that the pistons 33 extend again and the bracket 8 is lowered. Both inlet lines of the OR-element 143 are pressurized, and therefore, so is the outlet side, which at the same time branches off to an inlet of the AND-element 141, which is pressurized in this manner. The other inlet is also pressurized via the control line 20, such that both the open-control line 13 and the close-control line 26 are pressurized. The soft top 4 is still held in the closed position.

In the next step, the selector switch 15 is switched back while the soft top compartment cover 5 is open, so that the bracket control line 24 becomes pressure-less. Because the control line 19 connects to an inlet of the AND-element 142, and then becomes pressure-less as well, the close-control line 23 at the outlet side of this AND-element becomes also pressure-less, so that the bracket drive 3 overall is held pressure-less. The selector switch 14 is switched to return flow as well, so that the left inlet of the OR-element 143 is pressure-less, and therefore also the left inlet of the AND-element 141. The close-control line 26 is connect to the outlet side of the AND-element 141 and thus becomes pressure-less. The open-control line 13 that is, however, directly connected with the control line 20 of the soft top compartment cover drive 6 is pressurized, the pistons 33 of the drive unit 2 thus retract, and the soft top 4 is opened with a pressure-less bracket drive 3.

Thereafter, the soft top compartment cover 5 will be closed. To this end, contrary to the first exemplary embodiment, the selector switch 16 is switched to back flow, so that the control line 20, and with that the open-control line 30, is pressure-less. Through parallel closing of the selector switch 14, the control line 18 is pressurized with a pressure medium, and with it the left inlet of the OR-element 143. Because of this, pressure is present at the outlet of the OR-element 143 as well, and therefore also at the left inlet of the OR-element 144 which passes the pressurization on to the close-control line 31. The pistons retract and the soft top compartment is closing.

According to FIG. 7, in the next step, a pressure-less circuit is achieved with a closed soft top 4, if the selector switches 14,15,16 are all switched to back flow.

To open the soft top 4, the soft top compartment cover 5 is initially opened and to this end, the open-control line 30 is pressurized via the through-circuit of the selector switch 16. At the same time, the open-control line 13 of the soft top drive 2 that is connected to the control line 20 is pressurized, so that the soft top 4 remains in its open position.

In the next step, the selector switch 14 is switched through, so that the control line 18 pressurizes the left side inlet of the OR-element 143, and with that also the outlet of the OR-element 143 and the two inlets of the AND element 141. In this way, the outlet line of the AND element 141 is pressurized as well, which is directly connected to the close-control line 26 for the soft top. Due to the different cross-sections of the surfaces on the piston head side and on the piston rod side, the soft top 4 is closed when both the open-control line 13 and the close-control line 26 are pressurized.

In the following step, the bracket 8 will be opened. To this end, in addition to the selector switch 16, the selector switch 15 is switched through as well, so that the open-control line 24 will be pressurized. At the same time, the selector switch 14 is switched to return flow, so that only one side of the AND-element 142 is pressurized, and in doing so, the outlet of the AND-element 141 that is connected to the close-control line 23 remains pressure-less. However, the close-control line 26 of the soft top drive 2 remains under pressure, because now the right side inlet of the OR-element 143 is pressurized, whose outlet line, therefore, remains pressurized, resulting in both inlets of the AND-element 141 remaining under pressure.

Next, the soft top compartment cover 5 will be closed. To this end, the selector switch 16 is switched to return flow. Via the outlet of the OR-element 143, the OR-element 144 remains pressurized at one inlet line; thus, its outlet line that is connected directly to the close-control line 31 for the soft top compartment cover drive 6 remains pressurized.

Finally, the bracket 8 will be lowered. To this end, the selector switch 14 as well as the selector switch 15 is switched through. In this way, the AND-element 142 is pressurized via both inlets, and with that also the close-control line 23, so that an extension of the pistons 33 is achieved and the bracket 8 swings downwards, if at the same time the open-control line 24 is pressurized.

By switching the selector switches 14,15 and 16 pressure-less, the initial position is then again established.

Also this exemplary embodiment shows that the drive unit 2 for the soft top 4 can be pressurized in the counter-direction G for closing the soft top 4, whereby the bracket drive 3 can be moved either in the opening direction F or in the counter-direction G or can be kept pressure-less. Thus, here too three different introductions of force to the second drive unit 3 can be realized, while the introduction of force to the first drive unit 2 remains the same. Still, overall only three controllable selector switches 14,15,16 are required, that is, one for each drive unit 2,3,6. This is particularly advantageous, because the typically used 3/2-type valves are precision instruments with high accuracy, and therefore, correspondingly high manufacturing costs. Thus, a cost reduction is achieved. In addition, weight can be spared as well due to the lighter construction of AND or OR valve elements 141,142,143,144.

What is claimed is:

1. A hydraulic switching device for controlling a pressurized pressure medium, comprising:

at least two movable drive units for producing movement in a functional direction and in a counter-direction, said drive units each having at least two connection lines for application of the pressurized pressure medium;

an externally controllable selector switches provided for controlling the pressurization of the pressure medium provided for each of said drive units, said externally controllable switches controlling application of the pressure medium to the connection lines of said at least two movable drive units with the exception that at least one connection line of the connection lines is kept pressurized throughout all switching positions of said externally controllable switches; and said connection lines of said at least two movable drive units being interconnected via at least one of logical AND and OR valve elements so that:

operation of a first drive unit of said at least two movable drive units in the functional direction is possible while at the same time a force release of a second drive unit of said at least two movable drive units is effectable, and operation of the first drive unit in the counter direction is possible while at the same time operation of the second drive unit in the functional direction, in the counter direction and a force release mode is effectable.

2. The hydraulic switching device as set forth in claim 1, wherein pressurization of both of said at least two connection lines of said at least two movable drive units with the pressure medium results in movement in one of the functional direction, or in the counter-direction.

3. The hydraulic switching device as set forth in claim 2, wherein said at least two movable drive units comprise hydraulic cylinders that have different cross-sections on a piston rod side and on a piston head side of a movable piston.

4. The hydraulic switching device as set forth in claim 1, wherein said at least two movable drive units include two drive units for movement of a soft top of a convertible vehicle as well as a movement of a bracket for the soft top.

5. The hydraulic switching device as set forth in claim 4, wherein said at least two movable drive units further include a drive unit for a soft top compartment cover of the convertible vehicle.

6. A hydraulic switching device for controlling a pressurized pressure medium, comprising:

at least two movable drive units including first and second drive unit for producing movement in a functional direction and in a counter-direction, said first and second drive units each having at least first and second connection lines for application of the pressurized pressure medium, the first connection line of the first drive unit being connected to the second connection line and the second drive unit via an AND valve element and an OR valve element connected in parallel to the AND valve element;

an externally controllable selector switches provided for controlling the pressurization of the pressure medium provided for each of said drive units, said externally controllable switches controlling application of the pressure medium to the connection lines of said at least two movable drive units; and said connection lines of said at least two movable drive units being interconnected via said AND and OR valve elements so that:

operation of a first drive unit of said at least two movable drive units in the functional direction is possible while at the same time a force release of a second drive unit of said at least two movable drive units is effectable, and operation of the first drive unit in the counter direction is possible while at the same time operation of the second drive unit in the functional direction, in the counter direction and a force release mode is effectable.

7. The hydraulic switching device as set forth in claim 6 wherein said AND and OR valve elements include exactly one AND -element and one OR-element.

8. A hydraulic switching device for controlling a pressurized pressure medium, comprising:

three drive units for producing movement in a functional direction and in a counter-direction, said drive units each having at least two connection lines for application of the pressurized pressure medium;

an externally controllable selector switches provided for controlling the pressurization of the pressure medium provided for each of said drive units, said externally controllable switches controlling application of the pressure medium to the connection lines of said at least two movable drive units; and said connection lines of said drive units being interconnected via exactly two AND valve elements and two OR valve elements so that:

operation of a first drive unit of said drive units in the functional direction is possible while at the same time a force release of a second drive unit of said drive units is effectable, and operation of the first drive unit in the counter direction is possible while at the same time operation of the second drive unit in the functional direction, in the counter direction and a force release mode is effectable.

* * * * *